United States Patent [19]

Wood

[11] Patent Number: 4,637,084

[45] Date of Patent: Jan. 20, 1987

[54] CRIMPING AND CUTTING TOOL

[76] Inventor: Michael D. Wood, 2301 - 139th Ave., N.W., Anoka, Minn. 55303

[21] Appl. No.: 678,968

[22] Filed: Dec. 6, 1984

Related U.S. Application Data

[63] Continuation-in-part of Ser. No. 193,534, Jan. 3, 1980, abandoned.

[51] Int. Cl.[4] ..... B25F 1/00

[52] U.S. Cl. ..... 7/134; 72/410; 140/106; 30/254; 29/751

[58] Field of Search ..... 7/132, 134; 72/410, 72/409; 140/106; 29/751; 81/303-306; 30/254, 257, 259, 194, 251

[56] References Cited

U.S. PATENT DOCUMENTS

| | | | |
|---|---|---|---|
| 156,073 | 10/1874 | Chrisman . | |
| 965,198 | 7/1910 | Kinsel et al. . | |
| 1,079,997 | 12/1913 | Wernimont . | |
| 1,469,072 | 9/1923 | Dodson | 30/251 |
| 1,771,733 | 7/1930 | Ott . | |
| 1,924,837 | 8/1933 | Crause . | |
| 2,583,625 | 1/1952 | Bergan . | |
| 3,120,773 | 2/1964 | Esser . | |
| 3,177,693 | 4/1965 | Batcheller . | |
| 3,447,172 | 6/1969 | Clark . | |
| 3,525,107 | 8/1970 | Hays . | |
| 3,654,647 | 4/1972 | Neff . | |
| 3,694,834 | 10/1972 | Daniels, Jr. . | |
| 3,699,595 | 10/1972 | Tofflemire . | |
| 3,903,725 | 9/1975 | Rommel . | |
| 4,043,174 | 8/1977 | Paolino . | |

FOREIGN PATENT DOCUMENTS

| | | |
|---|---|---|
| 1112772 | 8/1961 | Fed. Rep. of Germany . |

*Primary Examiner*—Roscoe V. Parker

*Attorney, Agent, or Firm*—Burd, Bartz & Gutenkauf

[57] ABSTRACT

A crimping and cutting tool useable for cutting wire and connection of a ferrule tip type electrical connector to an electrically conductive wire. The tool includes first and second lever members pivotally connected with a pivot pin. Each lever member has a head with a cutting jaw and a crimping jaw and a handle. The crimping jaws have alternative teeth and recesses in opposition to one another. The crimping jaws are movable toward one another to crimping position by applying hand force on the levers wherein each of the teeth of one of the crimping jaws fills a recess of the opposite jaw. The recesses have differing sizes such that differing sizes of electrical connectors or ferrules can be accommodated in the recesses and crimped therein. Wire cutting jaws have convex curved cutting edges located above the pivot pin.

25 Claims, 15 Drawing Figures

Fig. 1
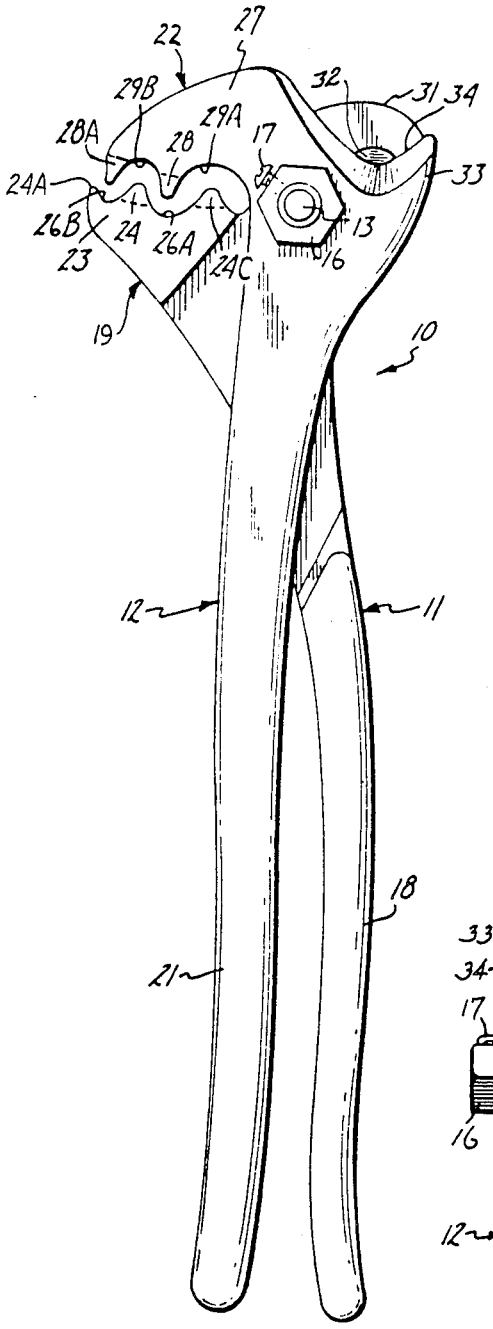
Fig. 2
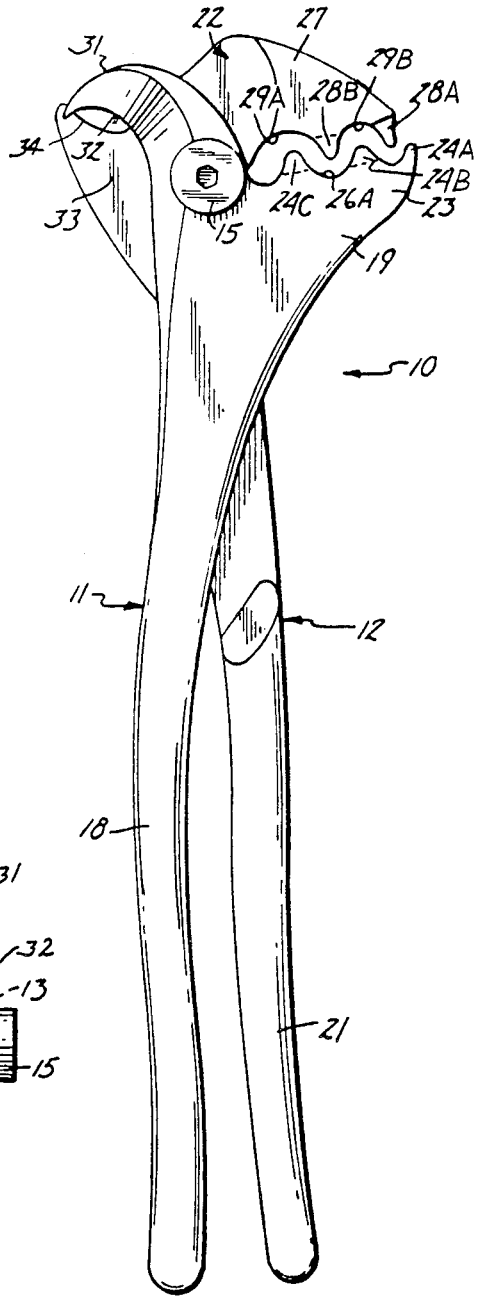
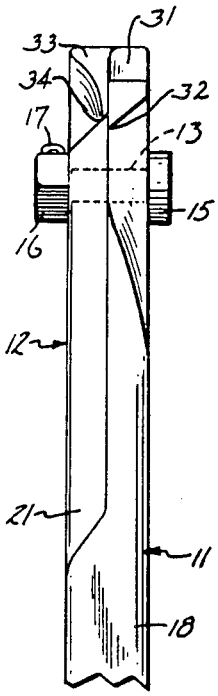
Fig. 3

Fig. 5
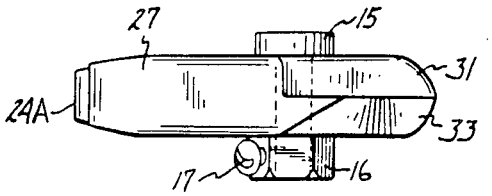
Fig. 4
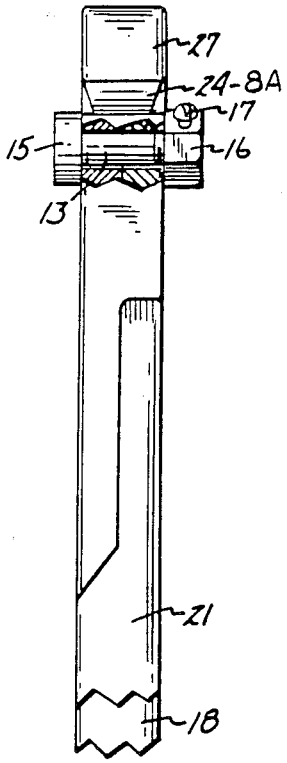
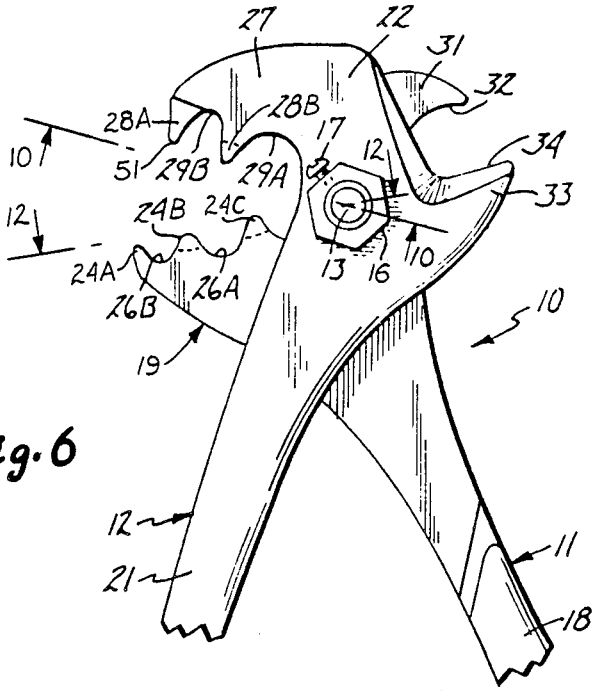
Fig. 6
Fig. 7
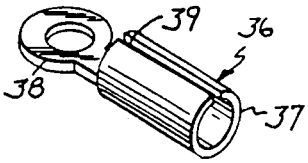
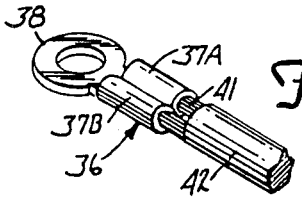
Fig. 9
Fig. 8
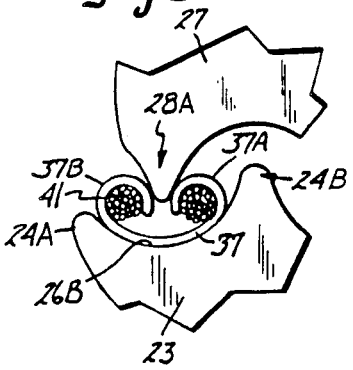

CRIMPING AND CUTTING TOOL

CROSS REFERENCE TO RELATED APPLICATION

This application is a continuation-in-part of U.S. patent application Ser. No. 193,534 filed Jan. 3, 1980, now abandoned.

FIELD OF INVENTION

The field of the invention is hand tools used to crimp electrical connectors onto wire and cut electrical wire.

BACKGROUND OF INVENTION

Numerous plier-type hand tools are disclosed in the prior art for cutting and stripping insulation from electrical wire and crimping terminals on the end of the wire. Examples of this type of hand tool are disclosed by Esser in U.S. Pat. No. 3,120,773; Hays in U.S. Pat. No. 3,525,107; Neff in U.S. Pat. No. 3,654,647; and Tofflemire in U.S. Pat. No. 3,699,595. These hand tools have pivotally arranged levels joined to jaws that perform crimping and cutting operations. The jaws have oppositely arranged teeth and recesses that facilitate crimping of a connector onto a wire. Considerable hand force must be applied to the levers to affect the crimping of a connector on a wire and cutting of a wire.

SUMMARY OF IN THE INVENTION

The invention pertains to a manually operable electrician's tool for crimping or fastening wire gripping portions of solderless electric wire connectors or terminals or the like to electrically conductive wire. The tool has a relatively large mechanical advantage so that a hand force can crimp relatively large electrical connectors onto the ends of wire. The crimped connector is compressed to a tight relationship with the wire to provide a positive electrical connection between the connector and the wire. Such connectors typically are formed with a ferrule or tubular barrel portion for connection to the wire. The barrel portion can have a longitudinal slot. The end of the wire is inserted in the tubular barrel portion which is then crimped in the vicinity of the slot to securely hold the connector with respect to the wire and provide a good electrical union between the connector and wire.

The invention comprises a tool useable to cut wire and crimp an electrical connector on the end of the wire. The tool is useable to crimp electrical connectors of varying sizes. A pair of lever members are pivotally connected together with a pivot pin. Each lever member has a head at one end and the handle at the opposite end. Each head has a crimping jaw with a working surface orientated toward a working surface of the opposite crimping jaw to be closed on closure of the handles. The working surface of each jaw has a plurality of spaced arcuate recesses and a plurality of inwardly projecting teeth adjacent the recesses. Each jaw has an outer tooth and at least one inner tooth. The inner teeth of the jaws have central grooves separating transversely spaced tooth projections. The tooth projections bite into the connector and deform separate portions of the connector into the wire during the crimping operation. This provides a tight and positive electrical engagement between the connector and the wire. The jaws are positioned so that each tooth of one jaw faces a recess of the other jaw. Upon closure of the handles, the teeth of each jaw move into and fill the space defined by a recess of the opposite jaw. The recesses are of differing sizes in order to accommodate the barrel portions of various sizes of electric connectors or terminals. Each head also has a cutting jaw. Each cutting jaw has an inwardly concave curved cutting edge located above the pivot pin joining the lever members together. When the cutting jaws are moved toward their closed position, the wire is progressively sheared by the cutting edges of the cutting jaws. The cutting lever arms of the two cutting jaws are not equal. The first jaw has a shorter lever arm and therefore a greater cutting force. This results in progressive shearing of the wire as the cutting jaws are moved together. There is a sharp cutting of the wire by the application of minimum force on the levers. The preferred form of the crimping and wire cutting tool has first and second lever members. Each lever member has a head and a handle. The first lever member has a first crimping jaw located at substantially a right angle relation to the handle. A first wire cutting jaw is positioned at substantially a right angle relation to the first handle and opposite the first crimping jaw. The second lever member has a second head and a elongated handle extended from the second head. The second head has a second crimping jaw positioned at substantially a right angle relative to the second handle. A second wire cutting jaw is positioned at substantially a right angle relative to the second handle and opposite the second crimping jaw. A pivot means pivotally connects the first and second members with the first and second handle positioned for rotational movement towards one another to close the first and second crimping jaws and the first and second cutting jaws. The pivot means is located below the crimping and cutting jaws of the first lever whereby the lever arm of the first cutting jaw is longer than the lever arm of the second cutting jaw. The first crimping jaw has alternating teeth and arcuate recesses in facing relationship to the second crimping jaw. The second crimping jaw has alternate teeth and arcuate recesses in facing relationship to the recesses and teeth of the first crimping jaw. The teeth of the first and second crimping jaws have concave curved sides and are progressively shorter in length from the inside tooth to the outside tooth with rspect to the pivot means. The recesses of the first and second crimping jaws are progressively smaller in curvature from the inside recess to the outside recess with respect to the pivot means. This allows the tool to be used to crimp different sized connectors. The inside teeth have central grooves separating the teeth into two tooth portions. The tooth portions enable the tool to be used to crimp relatively large connectors. The teeth and recesses of the crimping jaws are positioned such that when the crimping jaws are closed the teeth occupy the space defined by the arcuate recesses in the adjacent crimping jaw.

IN THE DRAWING

FIG. 1 is a side elevational view of a crimping and cutting tool according to the invention;

FIG. 2 is a side elevational view of the crimping and cutting tool of FIG. 1 showing the opposite side thereof;

FIG. 3 is an end view partially fragmented of the crimping and cutting tool of FIG. 1;

FIG. 4 is an end view partly sectioned and fragmented of the crimping and cutting tool of FIG. 3 showing the opposite end thereof;

FIG. 5 is a top plan view of the crimping and cutting tool of FIG. 1;

FIG. 6 is a partly fragmented side elevational view of the crimping and cutting tool of FIG. 1 shown the jaws in an open position;

FIG. 7 is a perspective view of an electrical connector for use with the crimping and cutting tool of the invention;

FIG. 8 is a partially fragmented side elevational view of the crimping and cutting tool of FIG. 1 operating to crimp an electrical connector;

FIG. 9 is a perspective view of an electrical connector like that of FIG. 7 shown in assembled relationship to the end of a wire segment.

DESCRIPTION OF A PREFERRED EMBODIMENT

Figure 10:
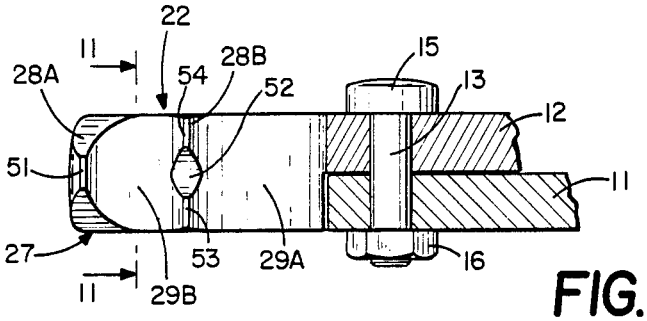
FIG. 10 is an enlarged sectional view taken along line 10—10 of FIG. 6.
Figure 12:
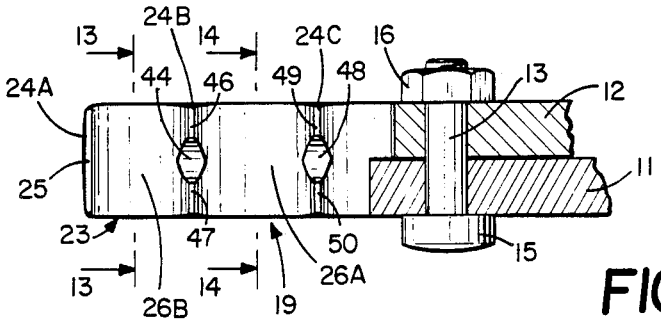
FIG. 12 is an enlarged sectional view taken along line 12—12 of FIG. 6.
Figure 15:
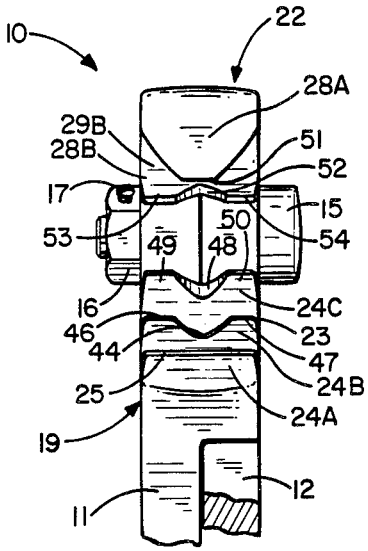
FIG. 15 is an end view of the open crimping jaws.
Figure 11:
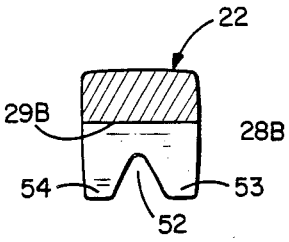
FIG. 11 is a sectional view taken along line 11—11 of FIG. 10.

Referring to the drawing, there shown in FIGS. 1 through 5 a crimping and cutting tool indicated generally at 10 according to the present invention used to cut wire and crimp an electrical connector onto the end of a wire. Tool 10 has first and second elongated lever members 11 and 12 pivotally interconnected between the jaw or upper portions thereof by a pivot pin 13. Pin 13 has a head 15 at one end and a threaded opposite end engaged by a nut 16 further secured by a set screw 17 thread in nut 16 and turned into engagement with the end of pin 13. Pin 13, head 15 and nut 16 are a nut and bolt assembly that hold the engaging surfaces of the upper portions in surface engagement. Other types of pivot members can be used to pivotally connect lever members 11 and 12 together.

First lever member 11 has an elongated handle 18 extended away from pivot pin 13, and an enlarged head 19 in the vicinity of pivot pin 13. Likewise, a second lever member 12 has an elongated handle 21 extended away from pivot pin 13 and enlarged head 22 in the vicinity of pivot pin 13. Head 19 of first lever member 11 carries a first, upwardly orientated crimping jaw 23 generally disposed at a right angle relative to handle 18. Crimping jaw 23 has three teeth 24A, 24B and 24C separated by a pair of notches or generally arcuate recesses or grooves 26A and 26B of differing radii. As shown in FIGS. 5, 6, 12, 13 and 14, outer tooth 24A has a transverse linear lip 25. Lip 25 is continuous and has a rounded upper edge. Middle tooth 24B has a central V-shaped cavity 44 separating tooth projections 46 and 47. The outer ends of tooth projections 46 and 47 are transversely spaced from each other. Each tooth projection 46 and 47 has concave curved front and rear side surfaces that extend into recesses 26A and 26B. Inner tooth 24C has a central V-shaped cavity 49 separating tooth projections 49 and 50. The outer ends of tooth projections 49 and 50 are transversely spaced from each other. Each tooth projection 49 and 50 has concave curved front and rear side surfaces. The front side surfaces extend into recess 26A. Tooth projections 49 and 50 are larger than tooth projections 46 and 47. For example, tooth projections 49 and 50 can be twice as high as tooth projections 46 and 47. The bifurcated teeth 24B and 24C reduces friction forces on the connector during the crimping of a connector onto a wire. A hand force on levers 11 and 12 can be used to crimp a relatively large ferrule connector, such as a No. 1/0 electrical connector, onto a wire. The separate tooth projections form separate indentations in the connector forming a tight relationship between the connector and wire thereby providing a good electrical connection between the connector and wire. Each tooth projection 46, 47, 49 and 50 has concave curved side surfaces that taper outwardly toward each other and terminate in a rounded nose or crown. Teeth 24A, 24B and 24C are progressively shorter in length from the inside tooth 24C to the outside tooth 24A. The radii of recesses 25A and 26B are progressively shorter in length from the inside recess to the outside recess. In other words, recess 26A is larger than recess 26B.

Head 22 of second lever member 12 carries a second cooperating jaw 27 that is downwardly orientated as viewed in FIGS. 1 and 2 with working surfaces in facing relationship to the first crimping jaw 23. Second crimping jaw 27 is generally disposed at a right angle relative to second handle portion 21 and has a pair of downwardly directed teeth 28A and 28B and a pair of arcuate recesses 29A and 29B. Outer tooth 28A has downwardly and inwardly tapering lateral edges and downwardly converging front and rear side surfaces. The edges and side sufaces join an outer transverse lip 51. Lip 51 is located across the center of tooth 28A and has a length of about one-half the length of lip 25. Inner tooth 28B has a central V-shaped cavity 52 separating tooth projections 53 and 54. The outer ends of tooth projections 53 and 54 are transversely spaced from each other. Each projection of tooth 28B has concave curved sides that taper downwardly toward each other and terminates in a rounded nose or crown. Teeth 28A and 28B are progressively shorter in length from inside tooth 28B to outside tooth 28A. Teeth 28A and 28B of second crimping jaw 27 are in rotational alignment with arcuate recesses 26A and 26B of first crimping jaw 23. When jaws 23 and 27 are in the closed position, as shown in FIG. 1, teeth 28A and 28B are located along lines midway between adjacent teeth 24A, 24B and 24C and intersecting the bottom of recesses 26A and 26B. The crowns of teeth 28A and 28B are spaced from the bottom of recesses 26A and 26B. The interior pair of teeth 24B and 24C of first crimping jaw 23 are in rotational alignment with arcuate recesses 29A and 29B of second crimping jaw 27. When jaws 23 and 27 are in the closed position, as shown in FIG. 1, the crowns of interior pairs of teeth 24B and 24C are located adjacent the bottoms of recesses 29A and 29B. Tooth 24B is located along a line midway between adjacent teeth 28A and 28B. The arcuate recesses 29A and 29B of second crimping jaw 27 are also of differing radii. The radius of recess 29A is larger than the radius of recess 29B. The larger of the recesses 26A, 29A are located closest to pivot pin 13 where greater force is exerted upon closure of the handles. The teeth of the crimping jaws are angularly moved into and out of the arcuate recesses of the opposite crimping jaw upon rotation of handles 18 and 21 respectively as in movement between positions shown in FIGS. 1 and 6.

Tool 10 also has a pair of cooperating wire cutting jaws 31 and 33 useable for the purpose of cutting wire.

A first cutting jaw 31 extends along a side of first head 19 opposite first crimping jaw 23 relative to pivot pin 13 and has an inwardly curved or hooked cutting edge or blade 32 downwardly orientated as viewed in FIGS. 1, 2 and 6. A second wire cutting jaw 33 extends along a side of second head 22 of second lever member 12 opposite second crimping jaw 27 in operative position to first wire cutting jaw 31 and upwardly orientated as viewed in FIGS. 1, 2 and 6. Second cutting jaw 33 has a cutting edge or blade 34 which moves in side-by-side cutting engagement with first cutting jaw blade 32 upon closure of the handles 18 and 21, and moves away upon opening the handles 18 and 21. Wire is cut by inserting it between the cutting blades 32 and 34 when in the open position, then closing handle 18 and 21 to effect progressive cutting of wire with a minimum of hand force. As shown in FIGS. 1 and 2 of the drawing, the arcuate concave cutting edge 34 of cutting jaw 33 has a greater distance from the axis of rotation of pin 13 than the arcuate concave cutting edge 32 of cutting jaw 31. The cutting lever arm of the first cutting jaw 31 is shorter than the cutting lever arm of the second cutting jaw 33. Since cutting jaw 31 has a shorter cutting lever arm, it has a greater cutting force thereby resulting in the progressive shearing of the wire between cutting edges 32 and 34. The wire is sharply cut with a minimum of hand force on the lever members 11 and 12.

Tool 10 is useable in connecting wire to electrical terminals or connectors of the type shown in FIG. 7. An unassembled electrical terminal, indicated generally at 36 in FIG. 7, has a ferrule or tubular barrel portion 37 and a terminal connector 38. An elongated slot 39 extends the length of barrel portion 37.

In use, the exposed or stripped end 41 of a stranded, insulated conductive wire 42 is inserted in the tubular end of split barrel section 37 of connector 36. The connector can be a continuous cylindrical member or sleeve that is placed over the stripped end of the wire. Barrel section 37 is then positioned in one of the recesses 26A, 26B, 29A, 29B of either the first or second crimping jaws 23 and 27. A recess is chosen that best conforms to the outside dimensions of tubular portion 37 of connector 36. Recesses 26A, 26B, 29A and 29B are of varying radii in order to accommodate terminal connectors of differing dimensions. As shown in FIG. 8, barrel section 37 is positioned in a recess 26B and with slot 39 facing the opposing jaw 27. Handles 18 and 21 of tool 10 are then moved together whereby tooth 28A on opposing jaw 27 is moved into position within the corresponding recess 26B. Tooth 28A moves into position occupied by slot 39 and pushes the edges defining slot 39 inward forming smaller barrel portions 37A, 37B which crimp portions of stranded wire end 41 and hold it with respect to the terminal connector 36 as shown in FIG. 9. The bottom barrel section 37 becomes larger in curvature as it is pressed into contact with recess 26B. The nose of tooth 28A fits into slot 39. Downward force of tooth 28A curls portions 37A and 37B about wire ends 41. The concave curved sides of tooth 28A as they move into recess 26B progressively turn portions 37A and 37B in opposite directions. Concave curved sides of tooth 28A slide on longitudinal parts of portions 37A and 37B causing substantially uniform curling of the metal of portions 37A and 37B. When jaws 23 and 27 are closed, portions 37A and 37B are turned into general cylindrical shapes around wire ends 41. Connector 36 is then useable in usual fashion to make an electrical connection with wire 42.

Figure 13:
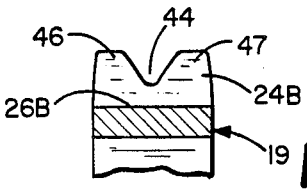
FIG. 13 is a sectional view taken along line 13—13 of FIG. 12.
Figure 14:
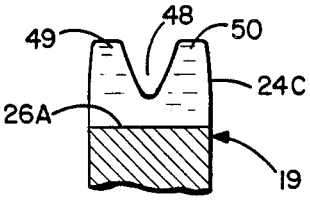
FIG. 14 is a sectional view taken along line 14—14 of FIG. 12.

Hand tool 10 is used to crimp different size electrical connectors and cut electrical wire. The electrical connectors are deformed into a tight electrical relationship with the wire with the use of hand force. The teeth of the first and second crimping jaws have concave curved sides and are progressively shorter in length from the inner tooth to the outer tooth with respect pivot pin 13. In the preferred embodiment of tool 10, the second crimping jaw 27 has an inner tooth 28B and an outer tooth 28A. The inner tooth 28B has a central groove 52 separating transversely spaced tooth projections 53 and 54. The first crimping jaw 23 has an inner tooth 24C, a middle tooth 24B, and an outer tooth 24A. The middle tooth 24B and inner tooth 24C each have a central groove separating transversely spaced tooth projections. As shown in FIG. 14, the inner tooth 24C has tooth projections 49 and 50 separated by the V-shaped groove 48. Referring to FIG. 13, the middle tooth 24B has tooth projections 46 and 47 separated with a V-shaped groove 44. The tooth projections 46 and 47 are substantially smaller than the tooth projections 49 and 50. The transversely spaced tooth projections concentrate the force applied to the electrical connector during the crimping operation. The tooth projections have smaller surface areas that reduce the friction forces on the connectors so that a hand force on lever members 11 and 12 can be used to effectively crimp relatively large connectors, such as No. 1/0 electrical connectors, onto a wire. The separate tooth projections provide separate indentations in the connectors forming a tight physical and electrical relationship between the connectors and the wires. This results in an advantageous firm electrical connection between the connectors and the wires.

Cutting jaws 33 and 31 are located at substantially a right angle relationship to the longitudinal axes of handle members 18 and 21. The cutting jaws 33 and 31 extend in a direction opposite of the crimping jaws 27 and 23. Pivot pin 13 is located below cutting jaws 31 and 33 when handle members 18 and 20 are in their closed positions, as seen in FIGS. 1 and 2. The first cutting jaw 31 has a cutting lever arm that is longer than the cutting lever arm of the second cutting jaw 33. Cutting or lever arms of the two cutting jaws 31 and 33 are not equal. The lever arms of the cutting jaws 31 and 33 are measured from the axis of the pivot pin 13 and the contact points of cutting edges 32 and 34 on the wire that is being cut. Jaw 33 has a shorter lever arm and therefore greater force resulting in the progressive shearing of the wire located between the cutting edges 32 and 34. This results in a sharp cut of the wire with a minimum of hand force on levers 11 and 12.

While there is shown and described one embodiment of the electrical connector crimping and wire cutting tool of the invention, it is understood that changes in the sizes and number of teeth and recesses in the jaws, materials, handles and cutting jaws can be made by those skilled in the art without departing from the invention. The invention is defined in the following claims.

I claim:

1. A connector crimping and wire cutting tool useable for connection of a ferrule type connector to an electrically conductive wire, comprising: a first lever member having a first head and an elongated first handle, said first head having a first crimping jaw positioned at substantially a right angle relative to the first handle, and a first wire cutting jaw positioned at substantially a right angle relative to the first handle and opposite the first crimping jaw; a second lever member with a second head and an elongated second handle extending from the second head, said second head having a second crimping jaw positioned at substantially a right angle relative to the second handle, and a second wire cutting jaw positioned at substantially a right angle relative to the second handle and opposite the second crimping jaw; pivot means pivotally assembling the first and second lever members with the first and second handles positioned for rotational movement toward one another to a closed position and away from one another to an open position with corresponding rotational movement of the first and second crimping jaws toward and away from one another between closed and open positions, and corresponding rotational movement of the first and second cutting jaws toward and away from one another between closed and open positions to cut wire, said pivot means being located below said crimping and cutting jaws of the first lever member whereby the lever arm of the first cutting jaw is longer than the lever arm of the second cutting jaw; said first crimping jaw having alternating teeth and arcuate recesses in facing relationship to the second crimping jaw, said second crimping jaw having alternating teeth and arcuate recesses in facing relationship to the first crimping jaw, said teeth of the first and second crimping jaws having concave curved sides and being progressively shorter in length from the inside tooth to the outside tooth with respect to the pivot means, and said recesses of the first and second crimping jaws being progressively smaller in curvature from the inside recess to the outside recess with respect to the pivot means; said teeth and recesses of the crimping jaws so positioned that in the closed position teeth of the first crimping jaw occupy the space defined by the arcuate recesses of the second crimping jaw, and teeth of the second crimping jaw occupy spaces defined by the arcuate recesses of the first crimping jaw whereby a tooth of one jaw and a corresponding arcuate recess of the opposite jaw are useable to crimp the ferrule of an electrical connector.

2. The tool of claim 1 wherein: said first crimping jaw has an inner tooth and an outer tooth, said inner tooth having a central groove separating transversely spaced tooth projections, said second crimping jaw has an inner tooth, a middle tooth, and an outer tooth, said middle tooth and inner tooth each having a central groove separating transversely spaced tooth projections.

3. The tool of claim 2 wherein: the outer tooth of the first crimping jaw has downwardly and inwardly tapering sides and a transverse lip, said lip having a transverse length shorter than the transverse length of the outer tooth of the second crimping jaw.

4. The tool of claim 2 wherein: the middle tooth of the second crimping jaw is shorter than the inner teeth of said first and second crimping jaws.

5. The tool of claim 2 wherein: the arcuate recesses of the first and second crimping jaws have different radii.

6. A connector crimping and wire cutting tool comprising: a first lever member having a first head and an elongated first handle extended from the first head, said head having a first wire cutting jaw projected at substantially a right angle relative to the first handle, said wire cutting jaw having an outwardly projected concave curved cutting edge, a first crimping jaw joined to the first head and extended at substantially a right angle relative to the first wire cutting jaw, said first crimping jaw having a plurality of first teeth spaced from each other, with first arcuate recesses, said first teeth having concave curved sides, a second lever member having a second head and an elongated second handle extended from the second head, said second head having a second wire cutting jaw projected at substantially a right angle relative to the second handle in the same direction as the first wire cutting jaw, said second jaw having an inwardly concave curved cutting edge located adjacent the cutting edge of the first wire cutting jaw, a second crimping jaw extended from said second head at a right angle relative to the second handle and opposite the second cutting jaw, said second crimping jaw having a plurality of second teeth spaced from each other with second arcuate recesses, said second teeth having concave curved sides, said first and second teeth positioned to project into the second and first recesses respectively when the first and second crimping jaws are in the closed position whereby one tooth of one jaw and a corresponding arcuate recess in an opposite crimping jaws are useable to crimp an electrical connector, pivot means pivotally assembling the first and second lever members with the first and second handles positioned for rotational movement toward one another to a closed position and away from one another to an open position with corresponding arcuate movement of the first and second cutting jaws toward and away from each other between open and closed positions, said pivot means being located below said first wire cutting jaw of the first lever whereby the lever arm of the first wire cutting jaw is longer than the lever arm of the second wire cutting jaw providing for progressive shearing of the wire between said jaws.

7. The jaw structure of claim 6 wherein: the first teeth are progressively shorter in length from the inside tooth to the outside tooth with respect to the pivot means.

8. The jaw structure of claim 6 wherein: the second teeth are progressively shorter in length from the inside tooth to the outside tooth with respect to the pivot means.

9. The jaw structure of claim 6 wherein: the first and second teeth are progressively shorter in length from the inside tooth to the outside tooth with respect to the pivot means.

10. The jaw structure of claim 6 wherein: the arcuate recesses of the first and second jaws are progressively smaller in curvature from the inside recess to the outside recess with respect to the pivot means.

11. The jaw structure of claim 6 wherein: the first teeth and second teeth are progressively shorter in length from the inside tooth to the outside tooth with respect to the pivot means, and said first and second recesses are progressively smaller in curvature from the inside recess to the outside recess with respect to the pivot means.

12. The tool of claim 6 wherein: said first crimping jaw has an inner tooth and an outer tooth, said inner tooth having a central groove separating transversely spaced tooth projections, said second crimping jaw has an inner tooth, a middle tooth, and an outer tooth, said middle tooth, and inner tooth each having a central groove separating transversely spaced tooth projections.

13. The tool of claim 12 wherein: the outer tooth of the first crimping jaw has downwardly and inwardly tapering sides and a transverse lip, said lip having a transverse length shorter than the transverse length of the outer tooth of the second crimping jaw.

14. The tool of claim 12 wherein: the middle tooth of the second crimping jaw is shorter than the inner teeth of said first and second crimping jaws.

15. A tool useable for connection of a ferrule type electrical connector to an electrically conductive wire, comprising:

a first lever member having a first head and an elongated handle extended from the head, said head having a first crimping jaw;

a second lever member having a second head and a second elongated handle extended from the head, said second head having a second crimping jaw;

pivot means pivotally assembling the first and second lever members with the first and second handles positioned for rotational movement toward one another to a closed position and away from one another to an open position with corresponding rotational movement of the first and second crimping jaws towards and away from one another;

said first crimping jaw having alternating teeth and arcuate recesses in facing relationship to the second crimping jaw, said second crimping jaw having alternating teeth and arcuate recesses in facing relationship to the first crimping jaw, at least one of said teeth of each the first and second crimping jaws having a groove and separated tooth projections, said teeth of the first and second jaws each have concave curved sides, said teeth and recesses of the crimping jaws so positioned that in the closed position teeth of the first crimping jaw occupy the space defined by the arcuate recesses of the second crimping jaw, and teeth of the second crimping jaw occupy spaces defined by the arcuate recesses of the first crimping jaw whereby a tooth of one jaw and a corresponding arcuate recess of the opposite jaw are useable to crimp the ferrule of an electrical connector.

16. The tool of claim 15 wherein: said first crimping jaw has an inner tooth and an outer tooth, said inner tooth having a central groove separating transversely spaced tooth projections, said second crimping jaw has an inner tooth, a middle tooth, and an outer tooth, said middle tooth and inner tooth each having a central groove separating transversely spaced tooth projections.

17. The tool of claim 16 wherein: the outer tooth of the first crimping jaw has downwardly and inwardly tapering sides and a transverse lip, said lip having a transverse length shorter than the transverse length of the outer tooth of the second crimping jaw.

18. The tool of claim 16 wherein: the middle tooth of the second crimping jaw is shorter than the inner teeth of said first and second crimping jaws.

19. The tool of claim 15 including: a first wire cutting jaw located on the first head opposite the first crimping jaw, a second wire cutting jaw located on the second head opposite the second crimping jaw, said first and second wire cutting jaws positioned for rotational movement away from one another upon opening of the handles and for rotational movement toward one another upon closure of the handles to cut wire.

20. The tool of claim 19 wherein: said first crimping jaw and first wire cutting jaw are positioned substantially at right angles relative to the first handle and said second crimping jaw and second wire cutting jaw are positioned substantially at right angles relative to the second handle.

21. The tool of claim 15 wherein: said first crimping jaw is positioned substantially at a right angle relative to the first handle, and said second crimping jaw is positioned substantially at a right angle relative to the second handle.

22. The tool of claim 15 wherein: the arcuate recesses of the first and second crimping jaws are in alignment with teeth of the opposite jaw and are of differing radii with larger radii recesses aligned progressively toward the pivot means.

23. The tool of claim 15 wherein: the teeth of the first and second jaws are progressively shorter in length from the inside tooth to the outside tooth with respect to the pivot means.

24. The tool of claim 23 wherein: the arcuate recesses of the first and second jaws are progressively smaller in curvature from the inside recess to the outside recess with respect to the pivot means.

25. The tool of claim 15 wherein: the teeth of the first and second jaws are progrssively shorter in length from the inside tooth to the outside tooth with respect to the pivot means, and said recesses of the first and second jaws are progressively smaller in curvature from the inside recess to the outside recess with respect to the pivot means.

* * * * *